US009010127B2

(12) United States Patent
Willis et al.

(10) Patent No.: US 9,010,127 B2
(45) Date of Patent: Apr. 21, 2015

(54) TRANSITION PIECE AFT FRAME ASSEMBLY HAVING A HEAT SHIELD

(75) Inventors: Christopher Paul Willis, Liberty, SC (US); William Lawrence Byrne, Simpsonville, SC (US); David William Cihlar, Greenville, SC (US); Donald Timothy Lemon, Greenville, SC (US); Patrick Benedict Melton, Horse Shoe, NC (US)

(73) Assignee: General Electric Company, Schenectady, NY (US)

( * ) Notice: Subject to any disclaimer, the term of this patent is extended or adjusted under 35 U.S.C. 154(b) by 558 days.

(21) Appl. No.: 13/410,417

(22) Filed: Mar. 2, 2012

(65) Prior Publication Data

US 2013/0227964 A1 Sep. 5, 2013

(51) Int. Cl.
*F02C 7/12* (2006.01)
*F01D 9/02* (2006.01)

(52) U.S. Cl.
CPC ..... *F01D 9/023* (2013.01)

(58) Field of Classification Search
CPC ..... F23R 3/90; F01D 9/023; F01D 25/12; F02C 7/18; F02C 7/185
USPC ..... 60/39.37, 796, 800, 806, 752–760
See application file for complete search history.

(56) References Cited

U.S. PATENT DOCUMENTS

| | | | | |
|---|---|---|---|---|
| 4,465,284 | A | 8/1984 | Szema | |
| 6,412,268 | B1 * | 7/2002 | Cromer et al. | 60/772 |
| 6,769,257 | B2 | 8/2004 | Kondo et al. | |
| 7,481,037 | B2 | 1/2009 | Takaya et al. | |
| 2002/0112483 | A1 | 8/2002 | Kondo et al. | |
| 2004/0031271 | A1 * | 2/2004 | Jorgensen | 60/796 |
| 2005/0241314 | A1 | 11/2005 | Takaya et al. | |
| 2010/0077761 | A1 * | 4/2010 | Johnson et al. | 60/752 |
| 2010/0247286 | A1 * | 9/2010 | Maldonado | 415/1 |
| 2011/0192171 | A1 * | 8/2011 | Sutcu et al. | 60/796 |

FOREIGN PATENT DOCUMENTS

| | | | |
|---|---|---|---|
| EP | 1143107 | A2 | 10/2001 |
| EP | 1239117 | A2 | 9/2002 |
| EP | 1731715 | A1 | 12/2006 |
| EP | 2402659 | A1 | 1/2012 |

OTHER PUBLICATIONS

Search Report and Written Opinion from EP Application No. 13157501.1 dated May 24, 2013.

* cited by examiner

*Primary Examiner* — Craig Kim
(74) *Attorney, Agent, or Firm* — Cantor Colburn LLP

(57) ABSTRACT

A transition piece aft frame assembly is provided, and includes a transition piece aft frame and a heat shield. The transition piece aft frame has an aft face. At least a portion of the aft face is exposed to an exhaust gas stream. The heat shield is connected to the transition piece aft frame. The heat shield is oriented to generally deflect the exhaust gas stream away from the aft face of the transition piece aft frame.

14 Claims, 2 Drawing Sheets

TRANSITION PIECE AFT FRAME ASSEMBLY HAVING A HEAT SHIELD

BACKGROUND OF THE INVENTION

The subject matter disclosed herein relates to a heat shield for a transition piece aft frame assembly.

Gas turbines generally include a compressor, a combustor, one or more fuel nozzles, and a turbine. Air enters the gas turbine through an air intake and is compressed by the compressor. The compressed air is then mixed with fuel supplied by the fuel nozzles. The air-fuel mixture is supplied to the combustor at a specified ratio for combustion. The combustion generates pressurized exhaust gases, which drive blades of the turbine.

The combustor includes a transition piece for confining and directing flow of combustion products from the combustor to a first stage nozzle. The transition piece includes a forward end and an aft end. Located between the aft end of the transition piece and the first stage nozzle is a transition piece aft frame. Exhaust gas flows through the transition piece at relatively high temperatures, therefore cracking due to thermal stresses and oxidation may occur in the transition piece aft frame along the inner and outer rails. To reduce the temperature of the transition piece aft frame, cooling holes or apertures may be provided in the transition piece aft frame. There are also various types of seal designs that are currently available to substantially prevent leaking of cooling air provided by the cooling apertures. However, there is no feature currently available to substantially prevent exhaust gases from reaching the transition piece aft frame in the region where cracking and oxidation may occur.

BRIEF DESCRIPTION OF THE INVENTION

According to one aspect of the invention, a transition piece aft frame assembly is provided, and includes a transition piece aft frame and a heat shield. The transition piece aft frame has an aft face. At least a portion of the aft face is exposed to an exhaust gas stream. The heat shield is connected to the transition piece aft frame. The heat shield is oriented to generally deflect the exhaust gas stream away from the aft face of the transition piece aft frame.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
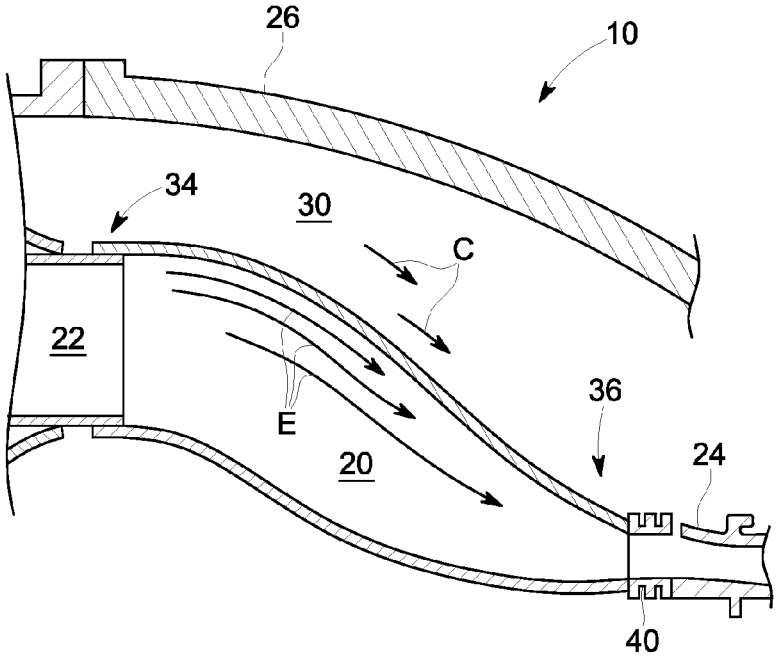
FIG. 1 is a cross-sectional view of a combustion system.

FIG. 1 is a cross-sectional view of an exemplary combustion system 10 for a gas turbine (not shown). The combustion system 10 includes a transition piece 20 for transporting an exhaust gas stream E from a combustor 22 to a first stage nozzle 24. The combustion system 10 also includes a compressor discharge casing 26. A compressor discharge air C is generally provided in a space 30 between the compressor discharge casing 26 and the transition piece 20. The compressor discharge air is provided to cool the components of the combustion system 10. The transition piece 20 includes a forward end 34 and an aft end 36. Located between the aft end 36 of the transition piece 20 and the first stage nozzle 24 is a transition piece aft frame 40. In one exemplary embodiment, the transition piece aft frame 40 may be attached to the aft end 36 of the transition piece 20 by any joining approach such as, for example, a weld.

Figure 2:
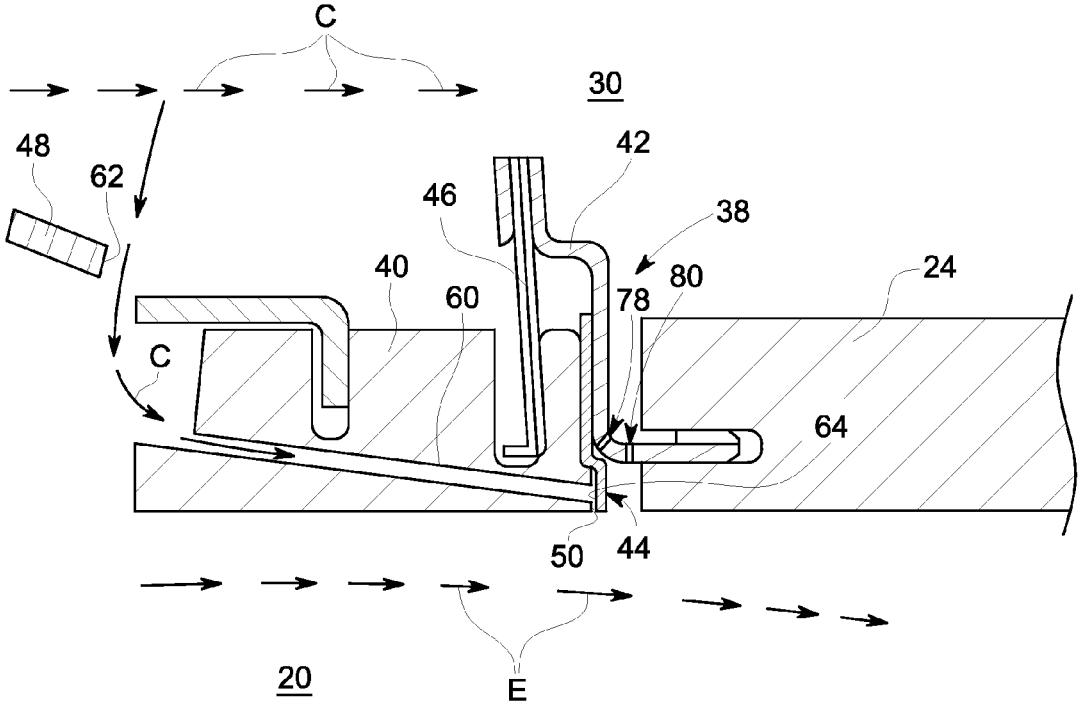
FIG. 2 is an enlarged, cross-sectioned view of a transition piece aft frame and a first stage nozzle shown in FIG. 1.

FIG. 2 is an enlarged, cross-sectional view of a transition piece aft frame assembly 38 that includes a portion of the transition piece aft frame 40 and a portion of the first stage nozzle 24. The transition piece aft frame assembly 38 includes a radial seal 42, a heat shield 44, a wear strip 46, and an impingement sleeve 48. In one embodiment, a portion of the heat shield 44 is attached to a portion of an aft face 50 of the transition piece aft frame 40 by any type of joining approach such as, for example, a weld. Also, in one exemplary embodiment, the heat shield 44 may be an extension of the wear strip 46. It should be noted that while a cross-sectional view of the transition piece aft frame assembly 38 is illustrated, the configurations as shown in FIGS. 2-4 may be implemented along all or a portion of the perimeter of the transition piece aft frame 40 (e.g., the configuration may be implemented along the lateral sides of the transition piece at frame 40 as well).

Referring now to both FIGS. 1-2, the exhaust gas stream E is located in the transition piece 20, and the compressor discharge air C is located in the space 30 between the compressor discharge casing 26 and the transition piece 20. The compressor discharge air C generally acts as a cooling or a dilution airflow stream that is used to cool the transition piece aft frame 40, as the compressor discharge air C has a lower temperature than the exhaust gas stream E. The heat shield 44 is oriented to generally deflect the exhaust gas stream E away from the aft face 50 of the transition piece aft frame 40. Thus, the heat shield 44 generally protects the aft face 50, and provides a barrier between the aft face 50 and the elevated temperatures of the exhaust gas stream E.

The transition piece aft frame 40 includes a plurality of dilution airflow apertures or passageways, one of which is illustrated in FIG. 2 as a dilution airflow passageway 60. The dilution airflow passageway 60 is located therethrough within the transition piece aft frame 40. At least some of the dilution airflow passageways located in the transition piece aft frame 40 receive a portion of the compressor discharge air C. Specifically, the compressor discharge air C passes through an aperture 62 located within the impingement sleeve 48, and is received by the dilution airflow passageway 60. The compressor discharge air C flows through the dilution airflow passageway 60 and is directed towards a face 64 of the heat shield 44 that generally opposes the aft face 50 of the transition piece aft frame 40. Specifically, the compressor discharge air C impinges against the face 64 of the heat shield 44, thereby providing cooling to the heat shield 44.

Figure 3:
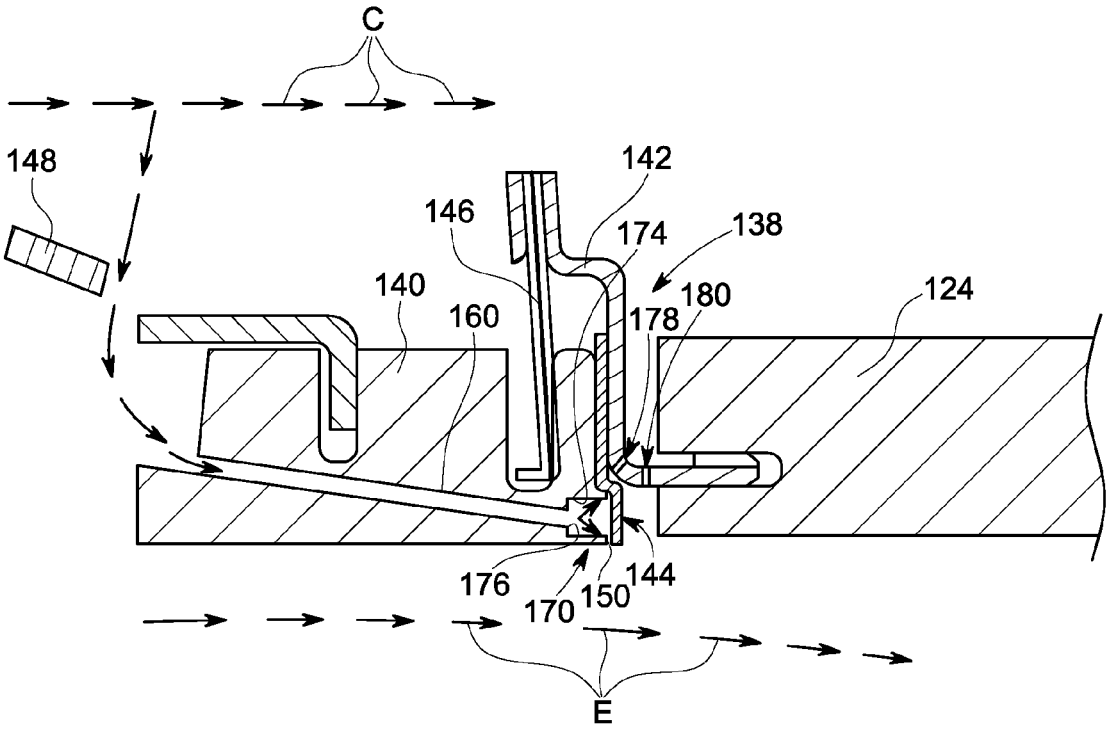
FIG. 3 is an alternative embodiment of the transition piece aft frame and the first stage nozzle shown in FIG. 2.
Figure 4:
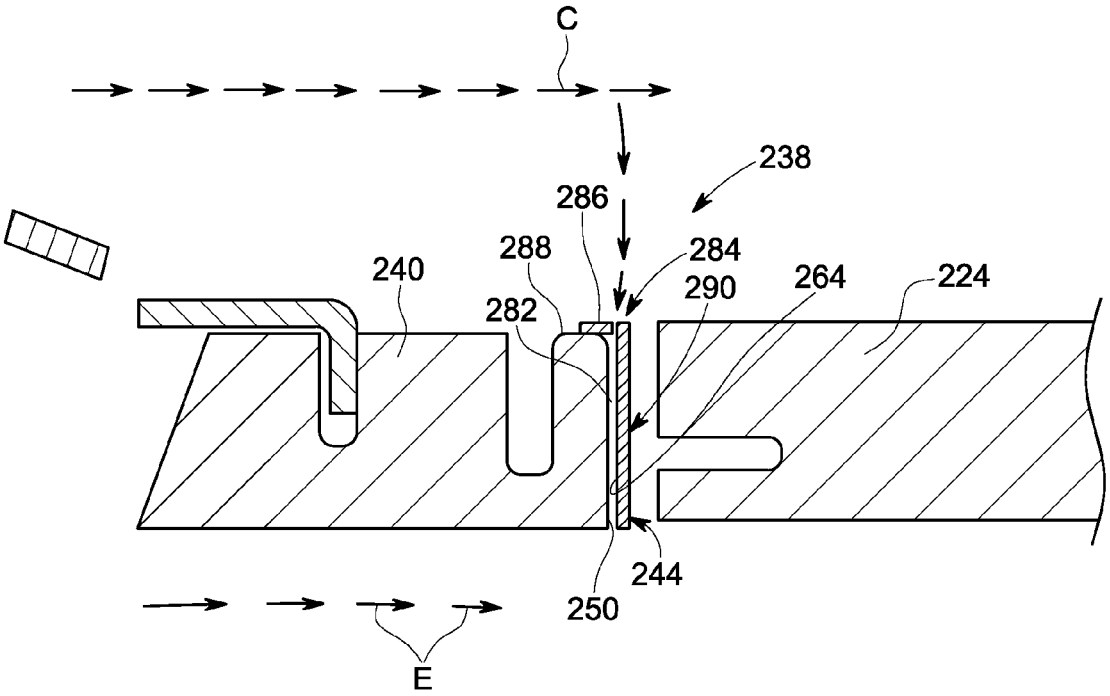
FIG. 4 is another alternative embodiment of the transition piece aft frame and the first stage nozzle shown in FIG. 2.

FIG. 3 is an alternative embodiment of a transition piece aft frame assembly 138 including a portion of a transition piece aft frame 140 and a first stage nozzle 124. In the embodiment as shown in FIG. 3, the transition piece aft frame 140 includes a series of recessed dilution airflow passageways, one of which is shown as a recessed dilution airflow passageway 160. The recessed dilution airflow passageway 160 includes a recessed portion 170. In one embodiment, the recessed portion 170 may include a trench configuration (not illustrated), where each of the recessed dilution airflow passageways 160 share a common recessed portion 170. In another embodiment, each of the recessed dilution airflow passageways 160 includes an individual recessed portion 170.

The compressor discharge air C flows through the recessed dilution airflow passageway 160, and impinges or contacts an inner wall 174 of the recessed portion 170 before exiting the transition piece aft frame 140. Impingement of the compressor discharge air C against the inner wall 174 provides enhanced cooling to the transition piece aft frame 140, which in turn may improve or extend the life of the transition piece aft frame 140. Moreover, the position of the recessed portion 170 acts to offset an opening 176 of the recessed dilution airflow passageway 160 from the aft face 150 of the transition piece aft frame 140. Offsetting the opening 176 of the recessed dilution airflow passageway 160 from the aft face 150 of the transition piece aft frame 140 in turn may offset the corresponding stress concentration associated with the opening 176 away from the aft face 150.

Turning back to FIG. 2, in one embodiment the radial seal 42 includes a heat shield aperture 78 and a first stage nozzle aperture 80. A portion of the compressor discharge air C may flow through the heat shield aperture 78 and the first stage nozzle aperture 80. Specifically, a portion of the compressor discharge air C flows through the heat shield aperture 78. The heat shield aperture 78 is positioned to direct the compressor discharge air C towards the heat shield 44, where the compressor discharge air C impinges against and cools the heat shield 44. A portion of the compressor discharge air C flows through the first stage nozzle aperture 80 as well. The first stage nozzle aperture 80 is positioned to direct the compressor discharge air C towards the first stage nozzle 24, where the compressor discharge air C impinges against and cools the first stage nozzle 24. Providing the heat shield the first stage nozzle aperture 80 in the heat shield 44 may be necessary in at least some embodiments to provide cooling, as the heat shield 44 may impede or block the flow of the compressor discharge air C to the first stage nozzle 24.

FIG. 4 is yet another embodiment of a transition piece aft frame assembly 238 including a portion of a transition piece aft frame 240 and a first stage nozzle 224. The transition piece aft frame 240 includes a heat shield 244. It should be noted that the transition piece aft frame 240 may also include a radial seal, however the radial seal is not shown in FIG. 4 for clarity. A portion 286 of the heat shield 244 is attached to a surface 288 of the transition piece aft frame 240. In the embodiment as shown in FIG. 4, the portion 286 of the heat shield 244 is generally perpendicular to an aft face 250 of the transition piece aft frame 240. Although FIG. 4 illustrates the portion 286 of the heat shield 244 generally perpendicular to the aft face 250, it is to be understood that the portion 286 of the heat shield 244 may be oriented in relation to the aft face 250 in other configurations as well.

In the embodiment as shown in FIG. 4, a portion 290 of the heat shield 244 is generally parallel with the aft face 250 of the transition piece aft frame 240. A passageway 282 is located between a face 264 of the heat shield 244 and the aft face 250 of the transition piece aft frame 240. The face 264 of the heat shield 244 generally opposes the aft face 250 of the transition piece aft frame 240. FIG. 4 also illustrates a transition piece aft frame aperture 284 located therethrough within the heat shield 244. The transition piece aft frame aperture 284 allows for the flow or ingression of the compressor discharge air C into the passageway 282. The compressor discharge air C flows past and provides cooling to the aft face 250 of the transition piece aft frame 240, as well as the face 264 of the heat shield 244.

The heat shield 44, 144 and 244 as shown in FIGS. 2-4 provides a barrier and protects the transition piece aft frame 40, 140 and 240 from elevated temperatures created by the exhaust gas stream E. Thus, the operating temperature of the transition piece aft frame 40, 140, and 240 will be lowered, thereby substantially reducing or eliminating cracking or oxidation of the transition piece aft frame 40, 140 and 240. The heat shield 44, 144 and 244 will also reduce the amount of rework for the transition piece aft frame 40, 140 and 240. Moreover, because the heat shield 44, 144 and 244 enhances the cooling of the transition piece aft frame 40, 140 and 240, a lower amount of compressor discharge air C may be required to cool the transition piece aft frame 40, 140 and 240, which in turn allows for an improvement in turbine efficiency, or makes the compressor discharge air C available for other regions of the turbine (not shown). Finally, the heat shield 44, 144 and 244 may also allow for transition piece repair intervals to be extended, which results in significant cost savings.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A transition piece aft frame assembly, comprising:

a transition piece aft frame having an aft face, at least a portion of the aft face being exposed to an exhaust gas stream, wherein the transition piece aft frame includes at least one dilution passageway located therethrough and terminating proximate the aft face, the at least one dilution passageway being configured for receiving a dilution airflow stream;

a first stage nozzle located proximate the aft face; and a heat shield connected to the aft face of the transition piece aft frame and located within a gap defined by the transition piece aft frame and the first stage nozzle, the heat shield oriented to generally deflect the exhaust gas stream away from the aft face of the transition piece aft frame, wherein the dilution airflow stream is directed towards and impinges against an upstream face of the heat shield that generally opposes the aft face of the transition piece aft frame.

2. The transition piece aft frame assembly as recited in claim 1, further comprising a wear strip, wherein the heat shield is an extension of the wear strip.

3. The transition piece aft frame assembly as recited in claim 1, wherein the at least one dilution passageway includes a recessed portion within the transition piece aft frame, wherein the dilution airflow stream impinges against an inner wall of the recessed portion before exiting the transition piece aft frame.

4. The transition piece aft frame assembly as recited in claim 1, further comprising a radial seal, wherein the radial seal includes a heat shield aperture formed therein that is positioned to receive a dilution airflow stream, the dilution airflow stream flowing through the heat shield aperture and impinging against the heat shield.

5. The transition piece aft frame assembly as recited in claim 4, wherein the radial seal includes a nozzle aperture formed therein that is positioned to receive the dilution airflow stream, the dilution airflow stream flowing through the nozzle aperture and cools at least one component located between the first stage nozzle and a transition piece.

6. The transition piece aft frame assembly as recited in claim 1, wherein a passageway is located between a face of the heat shield and the aft face of the transition piece aft frame, wherein the face of the heat shield generally opposes the aft face of the transition piece aft frame.

7. The transition piece aft frame assembly as recited in claim 6, wherein a transition piece aft frame aperture is located therethrough in the heat shield, and wherein the transition piece aft frame aperture allows ingression of a dilution airflow stream into the passageway.

8. A combustion system, comprising:

a combustor;

a transition piece for transporting an exhaust gas stream from the combustor, the transition piece including an aft end;

a transition piece aft frame having an aft face, the transition piece aft frame attached to the aft end of the transition piece, and at least a portion of the aft face being exposed to the exhaust gas stream, wherein the transition piece aft frame includes at least one dilution passageway located therethrough and terminating proximate the aft face, the at least one dilution passageway being configured for receiving a dilution airflow stream;

a first stage nozzle located proximate the aft face; and a heat shield connected to aft face of the transition piece aft frame and located within a gap defined by the transition piece aft frame and the first stage nozzle, the heat shield oriented to generally deflect the exhaust gas stream away from the aft face of the transition piece aft frame, wherein the dilution airflow stream is directed towards and impinges against an upstream face of the heat shield that generally opposes the aft face of the transition piece aft frame.

9. The combustion system as recited in claim 8, further comprising a wear strip, wherein the heat shield is an extension of the wear strip.

10. The combustion system as recited in claim 8, wherein the at least one dilution passageway includes a recessed portion within the transition piece aft frame, wherein the dilution airflow stream impinges against an inner wall of the recessed portion before exiting the transition piece aft frame.

11. The combustion system as recited in claim 8, further comprising a radial seal, wherein the radial seal includes a heat shield aperture formed therein that is positioned to receive a dilution airflow stream, the dilution airflow stream flowing through the heat shield aperture and impinging against the heat shield.

12. The combustion system as recited in claim 11, wherein the radial seal includes a nozzle aperture formed therein that is positioned to receive the dilution airflow stream, the dilution airflow stream flowing through the nozzle aperture and cools at least one component located between the first stage nozzle and the transition piece.

13. The combustion system as recited in claim 8, wherein a passageway is located between a face of the heat shield and the aft face of the transition piece aft frame, wherein the face of the heat shield generally opposes the aft face of the transition piece aft frame.

14. The combustion system as recited in claim 13, wherein a transition piece aft frame aperture is located therethrough in the heat shield, wherein the transition piece aft frame aperture allows ingression of a dilution airflow stream into the passageway.

* * * * *